United States Patent [19]

Pilcher et al.

[11] Patent Number: 4,641,458

[45] Date of Patent: Feb. 10, 1987

[54] JAIL DOOR OPERATING AND LOCKING MECHANISM

[76] Inventors: Walter R. Pilcher; James W. Pilcher, both of 1044 O'Neal La., Baton Rouge, La. 70816

[21] Appl. No.: 794,310

[22] Filed: Nov. 1, 1985

[51] Int. Cl.[4] ..... E05B 53/00

[52] U.S. Cl. ..... 49/20; 49/18; 49/140

[58] Field of Search ..... 49/15–20, 49/140

[56] References Cited

U.S. PATENT DOCUMENTS

| | | | |
|---|---|---|---|
| 584,753 | 6/1897 | York | 49/17 |
| 612,758 | 10/1898 | Van Dorn et al. | 49/16 |
| 1,587,810 | 6/1926 | Whitehouse | 49/17 |
| 1,739,897 | 12/1929 | Garber | 49/17 |
| 1,785,471 | 12/1930 | Youngblood | 49/20 |
| 1,836,698 | 12/1931 | White et al. | 49/20 |
| 2,012,327 | 8/1935 | Tracy | 49/20 |
| 2,104,661 | 1/1938 | Manly | 49/20 |
| 2,262,672 | 11/1941 | Hart et al. | 49/20 |
| 2,961,076 | 11/1960 | White et al. | 49/18 |
| 3,009,545 | 11/1961 | Young | 49/20 |
| 3,053,352 | 9/1962 | Browning et al. | 49/18 |
| 3,082,847 | 3/1963 | Young | 49/16 |
| 3,271,901 | 9/1966 | Bednar | 49/16 |
| 3,343,302 | 9/1967 | Browning et al. | 49/18 |
| 3,426,478 | 2/1969 | Sturges et al. | 49/16 |
| 3,564,772 | 2/1971 | Ozier et al. | 49/15 |
| 3,571,974 | 3/1971 | Browning et al. | 49/18 |
| 3,830,017 | 8/1974 | Markham | 49/18 |
| 3,866,354 | 2/1975 | Butt | 49/16 |
| 3,913,263 | 10/1975 | Butt | 49/16 |
| 3,961,447 | 6/1976 | Wolz | 49/362 |
| 4,190,985 | 3/1980 | Richards et al. | 49/16 |

*Primary Examiner*—Philip C. Kannan

*Attorney, Agent, or Firm*—Robert C. Tucker; William D. Kiesel

[57] ABSTRACT

A jail door operating and locking mechanism is provided, comprising a sliding jail door mechanism, lockable by a vertical lock bar, and having a mechanism permitting selective manual operation of cell doors, as well as selective power operation of cell doors, from a remote location. A spring loaded index assembly is provided, enabling indexing of selected doors as well as release of cell door control to prison inmates and retrieval of control when desired, all from a remote location. A carriage lock regulator assembly is also provided, comprising a regulator gear rack, regulator gear, regulator lock bar and regulator lock plate, in combination, which allow for overtravel in door operation.

16 Claims, 12 Drawing Figures

JAIL DOOR OPERATING AND LOCKING MECHANISM

BACKGROUND OF THE INVENTION

1. Field of the Invention

This invention relates generally to prison cell door operating and locking mechanisms and, more particularly, to remote controlled operating and locking mechanisms for sliding prison cell doors.

2. Prior Art

In prisons, it is desirable for prison cell doors to be remotely operable and lockable. Electrical operation of each individual cell door is preferable, enabling complete electrical control of each cell from a remote location. It is also preferable that individual electrical operation of each door be accomplished via an electric motor over each door. It is also desirable that the officer operating the cell door remain at the remote location throughout the operation cycle of the door, usually from a locked closed position to a locked open position and vice versa. This is especially true in situations where electrically operated door mechanisms fail, such as in power failure situations. Prior art cell door systems comprising over the door motors have provided for remote manual operation of doors, but only for gang opening or closing situations. In other words, in manual mode, all doors in a particular cell block which is serviced by a particular remote control can be opened or closed, but only in unison. Other prior art systems are available which allow selective individual manual operation of a particular cell door, but only if an officer enters the cell block and activates a release for the cell to be opened or closed. In some states, fire regulations additionally require that there be a capability for releasing cell doors for inmate control (i.e. releasing control of the door to the inmate so he/she can manually open the door). When this situation presents itself, it is desirable that an officer at a remote location be able to retrieve or release control of the door without entering the cell block. If some doors are open while others are closed, an indexing mechanism is necessary to retrieve manual control of the doors. Prior art devices have not addressed the problem of quickly relinquishing or retrieving control of individual doors to or from the inmates.

Most sliding cell doors are provided with a mechanism for actuating a vertical lock bar which either locks or unlocks the door in an open or closed position with respect to a fixed frame or grating. In order to achieve the desired situation wherein opening and closing, as well as locking and unlocking is controlled by an operator at a remote location, the vertical lock bar is usually moved between a locked and an unlocked position by travel of the door mechanism a designated distance past the open or closed position of the door. This additional movement of the door mechanism is known as "overtravel". Various means have been utilized in the prior art to achieve overtravel. Most involve complicated and expensive mechanical or electrical arrangements which may become jammed either inadvertently or through intentional inmate action.

It is also desirable to achieve a degree of redundancy in such locking mechanisms, while preserving the advantages of remote operation. Redundancy is necessary in riot conditions, wherein inmates have been known to obtain tools and attack the cell doors and lock bars. No device is currently available which offers selective remote operation of cell doors with a motor over each door in either electrical or manual mode, while achieving simplified overtravel and redundancy.

SUMMARY OF THE INVENTION

Therefore, it is an object of this invention to provide a jail door operating and locking mechanism which will selectively and remotely operate and lock individual cell doors via a motor or via manual operation.

It is still another object of this invention to provide a jail door operating and locking mechanism which may be indexed so as to allow the operator to selectively and manually gain control of or release control of any door in a given cell block whether or not the door is in the same position as other doors in the cell block.

It is a further object of this invention to provide a jail door operating and locking mechanism which utilizes a simplified and economical means of accomplishing overtravel.

It is still a further object of this invention to provide a jail door operating and locking mechanism which will lock in either open or closed positions without the necessity of a vertical lock bar.

It is an additional object of this invention to provide a jail door operating and locking mechanism which will operate jail doors quickly and efficiently in either motor-driven or manual mode.

It is still another object of this invention to provide a jail door operating and locking mechanism which will accomplish any combination of the above objectives.

Accordingly, a jail door operating and locking mechanism is provided, comprising a sliding jail door mechansim, lockable by a vertical lock bar, and having a mechanism permitting selective manual operation of cell doors, as well as selective power operation of cell doors, from a remote location. A spring loaded index assembly is provided, enabling indexing of selected doors as well as release of cell door control to prison inmates and retrieval of control when desired, all from a remote location. A carriage lock regulator assembly is also provided, comprising a regulator gear rack, regulator gear, regulator lock bar and regulator lock plate, in combination, which allow for overtravel in door operation.

DETAILED DESCRIPTION OF PREFERRED EMBODIMENTS OF THE INVENTION

Figure 1:
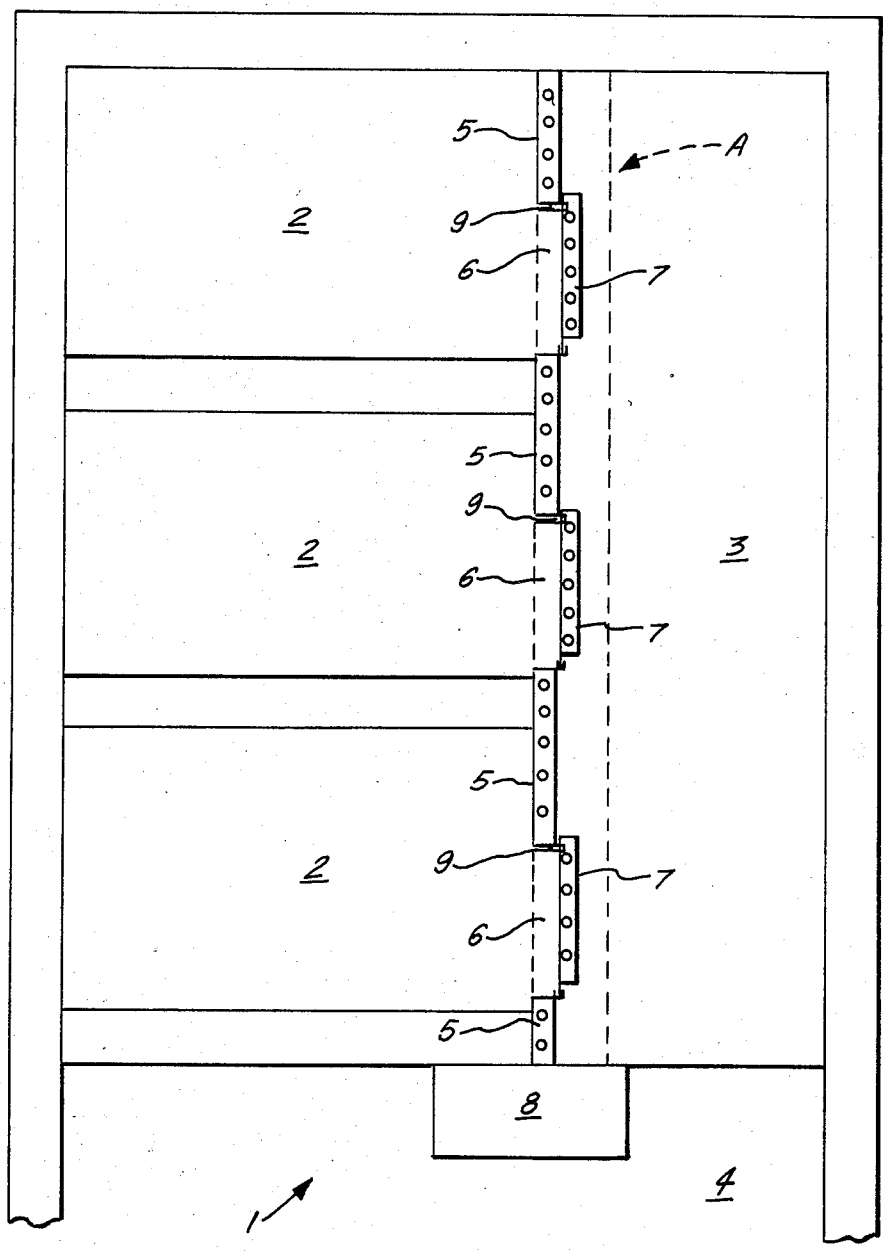
FIG. 1 is a schematic view of a cell block incorporating the invention with the track box housing shown in dashed lines for clarity.

As shown in FIG. 1, a typical cell block 1 comprises at least one row of cells 2 which are aligned along an inmate corridor 3. The cells 2 and corridor 3 typically are securely isolated from control area 4, where officers observe prisoner activity and control access to cells 2. The front of a typical cell 2 comprises fixed frame or grating 5 and a passageway 6, secured by a sliding cell door 7. Door 7 is locked in either open or closed position by a vertical lock bar 9 which prevents relative movement between door 7 and fixed grating 5. Movement of cell doors 7 is preferably controlled at a control cabinet 8 located inside control area 4. The inner workings of the door operating and locking mechanism are contained by a continuous track box housing A, which is fixedly positioned over cell doors 7, which shall be subsequently described in further detail. For purposes of a general view of the cell block 1, track box housing A is only shown in dashed outline. Among other things, track box housing A provides a fixed surface to which various other components of the door operating and locking mechanism may be attached. The cell door operating and locking mechanism preferably comprises several assemblies. Each assembly is given a letter designation herein, and various components of an assembly are each given a number designation, preceded by the letter designation of the particular assembly involved.

Figure 2:
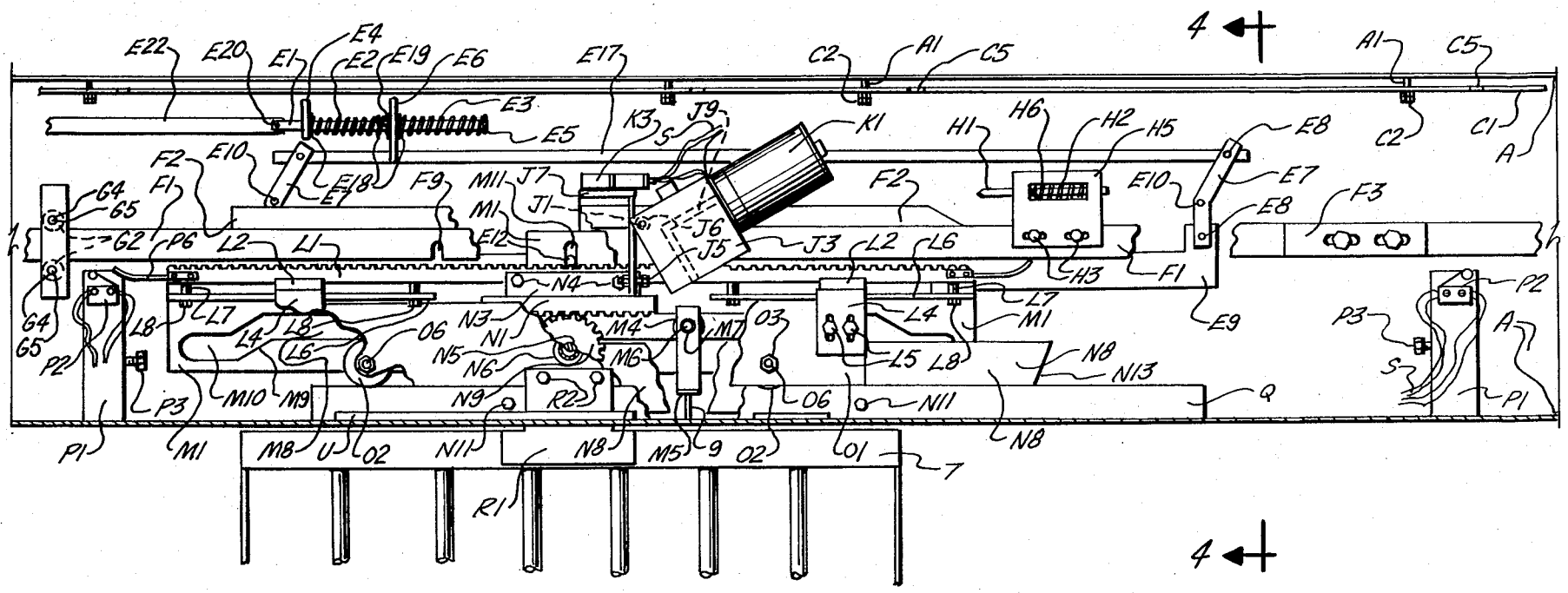
FIG. 2 is a sectional view of a preferred embodiment of the invention taken along line 2—2 of FIG. 4, with portions removed in order to view various internal components.
Figure 3:
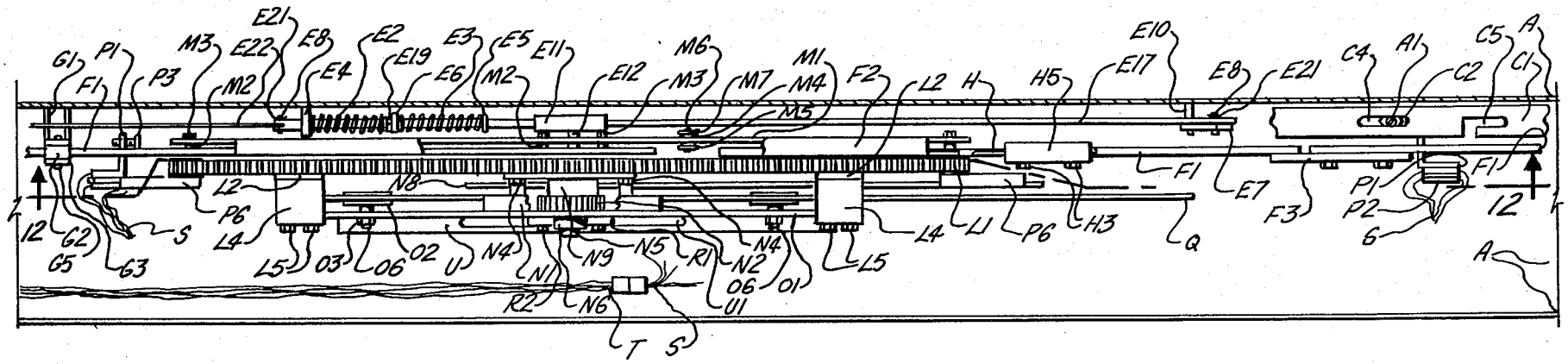
FIG. 3 is a sectional view of a preferred embodiment of the invention taken along line 3—3 of FIG. 4, with portions removed for clarity.
Figure 4:
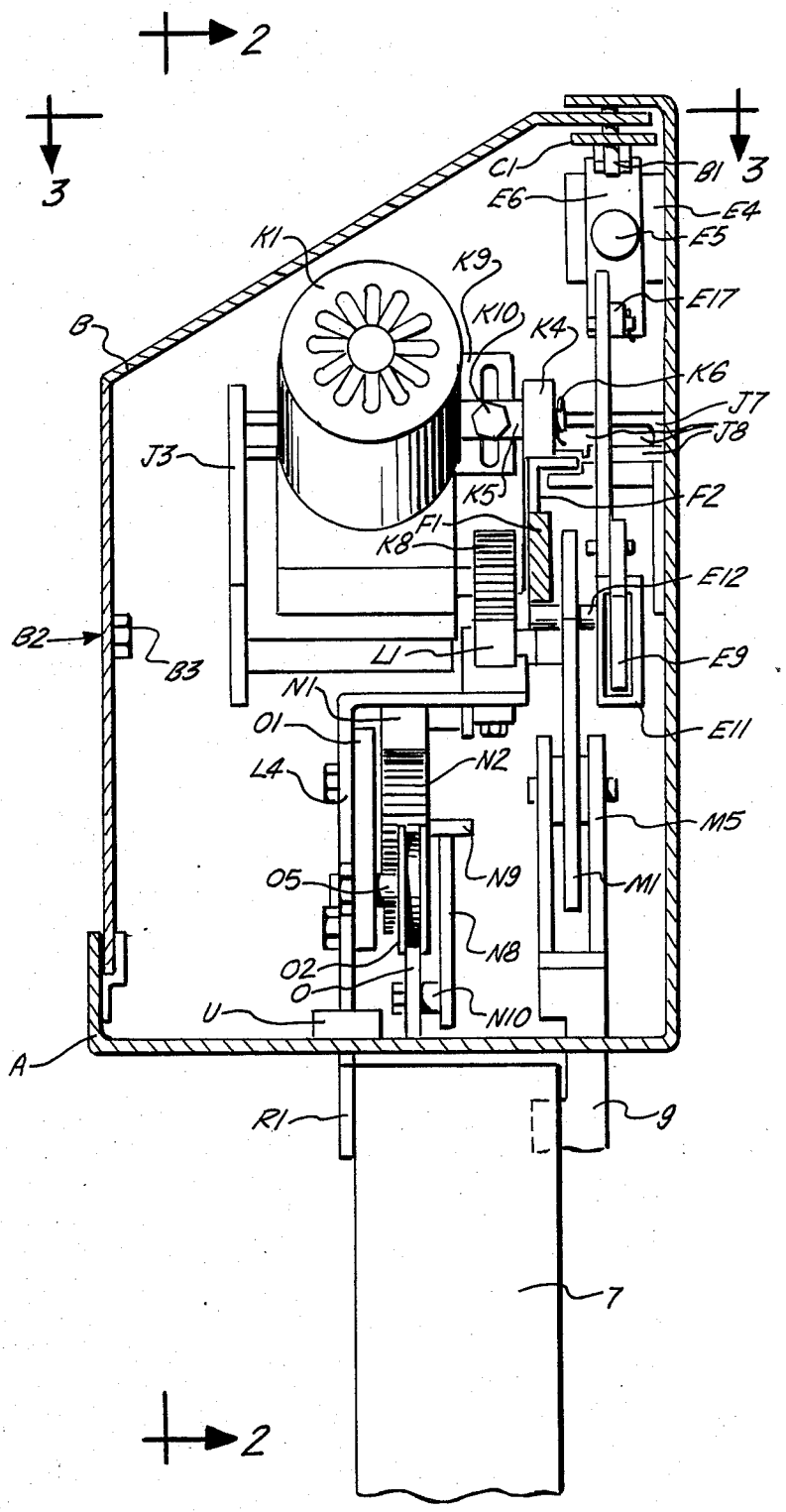
FIG. 4 is a sectional view of a preferred embodiment of the invention taken along line 4—4 of FIG. 2.
Figure 6:
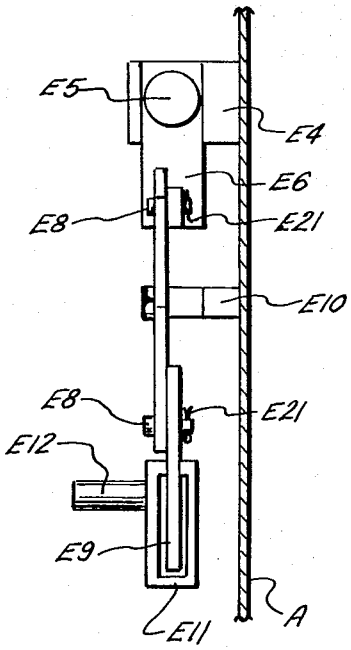
FIG. 6 is a more detailed end view of a preferred embodiment of the index assembly of this invention shown in FIG. 5.
Figure 10:
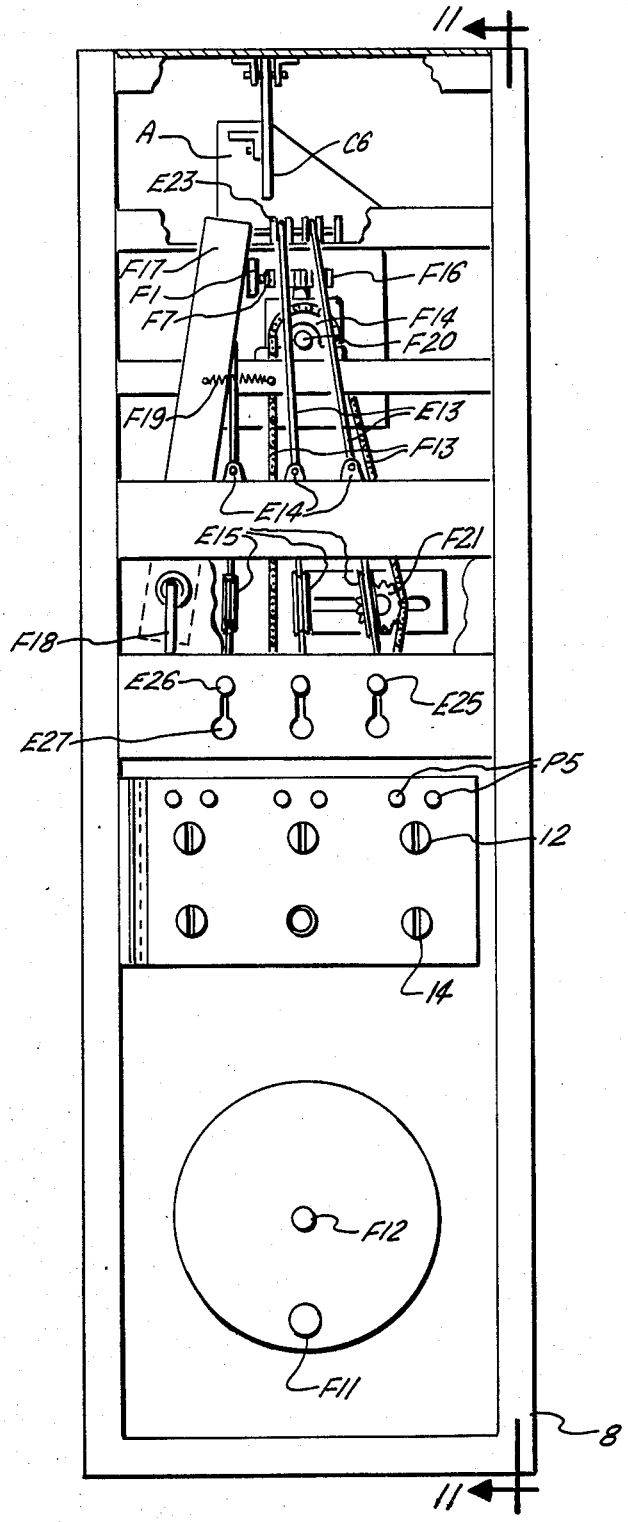
FIG. 10 is a front view of a preferred embodiment of the control cabinet of this invention, with portions removed for clarity.

The track box housing A (see FIGS. 2, 3 and 4) contains the various components for a particular row of cells 2, and encloses the components to prevent tampering by inmates. Access to the track box housing A is permitted via removable panel B. Panel B is held securely in place by the panel lock bar assembly C. Housing studs A1 extend downward from track box housing A. The panel lock bar C1 is held in place by aligning mounting slots C4 with housing studs A1 and fastening panel lock bar C1 thereon with panel lock bar nuts C2. Dowels B1 in panel B slide into L-shaped mounting slots C5. Thus, the panel B may be locked in place by drawing panel lock bar C1 (by pulling panel lock bar handle C6—see FIGS. 10 and 11) such that mounting slots C5 will secure dowels B1. Panel B may be lifted by screwing a threaded stud, bolt or other handle into hole B2 and fixed acorn nut B3, and then removing panel B.

An index assembly E, located over each door 7, provides a means for activating manual door operation (including locking and unlocking. Index assembly E is shown variously in FIGS. 2, 3, 4, 5, 6, 10 and 11. Indexing of each cell door mechanism (selection of a given door for remote manual operation) from the control cabinet 8 is accomplished via index connector E22, usually a steel tape. An index rod E1 is slidingly mounted in fixed stop E4, which is fixedly connected by welding or other suitable means to the back of track box housing A, and is connected to index connector by clevis pin E20 and secured by clevis cotter pin E21. First index spring E2 is slidingly mounted on rod E1, with washers E18 slidingly positioned on either end of first spring E2. First spring E2 is contained on rod E1 by index cotter pin E19, which is not essential to operation of the index assembly E. First spring E2 provides a means for maintaining tension on index tape E22. While one such means is shown in first spring E2, other means known in the art may be utilized. Additional washers E18 are slidingly mounted on either side of fixed movable stop E6, which is slidingly mounted on rod E1. A second index spring E3 is slidingly mounted on rod E1 on the opposite side of fixed movable stop E6 from first spring E2 and is contained by washer E18 on one end and by end stop E5 on the other. End stop E5 is fixedly connected to the end of rod E1. Fixed movable stop E6 is also fixedly connected to connector bar E17, which is pivotally connected at either end to the upper end of rockers E7 by clevis pins E8 and clevis cotter pins E21. Rockers E7 are pivotally connected to a fixed surface, such as the back of track box housing A by rocker shafts E10. The lower ends of rockers E7 are pivotally connected to the ends of the index slide bar E9 by clevis pins E8 and clevis cotter pins E21. Index slide E11 is slidably attached to index slide bar E9. index engagement pin E12 is fixedly attached to index slide E11. Rocker connector bar E17, rockers E7, index slide bar E9, index slide E11, and index engagement pin E12 together comprise a means for linking the travel bar F1 to the main gear rack L1.

The index connector E22 is connected to control cabinet 8 via index cable E13, which runs over pulley E23 to turnbuckle E15, which is connected to index selector pin E16. Connections at either end of index cable E13 are provided by index cable connectors E14, such as ball fasteners. The index selector pins E16 preferably have flat bodies E24 which slide in and are contained by selector slots E26 in face plate 13 of control cabinet 8. Face plate 13, among other things, provides a fixed surface to which various components in control cabinet 8 may be attached. Index selector pins E16 are pivotally and slidingly mounted in control cabinet 8 such that, when each index selector pin E16 is pulled downward in slot E26, it may then be locked in the downward position by pushing the pin E16 inward into the selector hole E27, which is preferably just large enough to receive enlarged selector pin head E25.

Thus, by pulling downward and locking the selector pin E16 for a particular cell door 7, rod E1 is pulled inward, such that end stop E5 moves toward fixed stop E4, causing rockers E7 to rotate counterclockwise, urging index engagement pin E12 upward. The index assembly E is positioned such that engagement pin E12 is situated just below travel bar F1. Therefore, when engagement pin E12 is urged upward in the fashion described above, the travel bar F1 will prevent upward movement, causing spring E3 to be compressed. As travel bar F1 moves horizontally and index notch F9 passes over pin E12, the stored energy in spring E3 is released, causing pin E12 to seat in index notch F9, activating manual operation of the door 7. It should be understood that index notch F9 could be located in the top of travel bar F1, and the operation of index assembly E could be reversed so as to cause index engagement pin E12 to engage index notch F9 from the top rather than from the bottom. Trunbuckle E15 provides a means for adjustment of the tension on index connector E22 and index cable E13, which is maintained by first spring E2 when selector pin E16 is in the up position.

Figure 5:
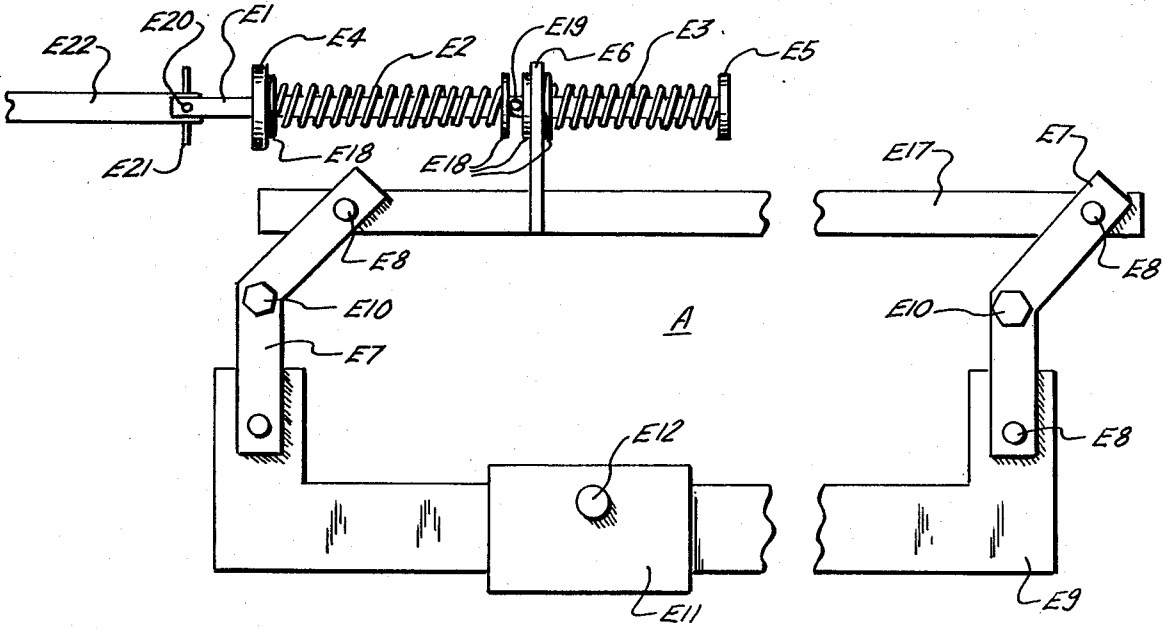
FIG. 5 is a more detailed side view of a preferred embodiment of the index assembly of this invention.
Figure 7:
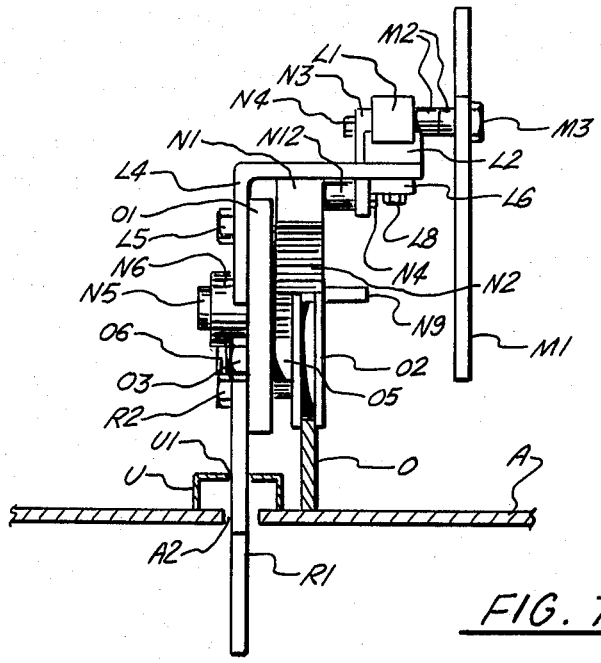
FIG. 7 is a more detailed end view of a preferred embodiment of the carriage lock regulator assembly of this invention.
Figure 8:
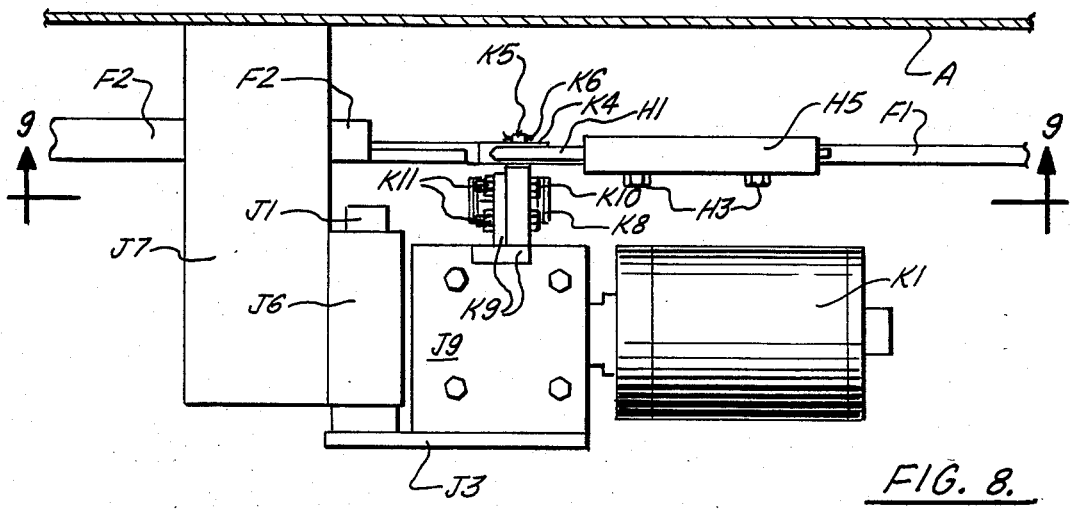
FIG. 8 is a more detailed top view of preferred embodiments of the motor hold down assembly, motor mounting bracket assembly, and motor assembly of this invention.

The travel bar assembly F shown in most of the FIG. 5, comprises components of a continuous bar means utilized to manually propel doors 7 from open to closed position and vice versa. The travel bar assembly F is also responsible for disengaging motor K1 in order to allow manually operation. The travel bar support assembly G provides a means for mounting and guiding the travel bar F1 as it travels between open and closed positions. The travel bar F1 runs substantially the entire length of track box housing A, and is spliced where necessary utilizing splice assemblies F3. While travel bar F1 is shown comprising a flat bar, the terms "travel bar assembly" or "travel bar" encompass any suitable rigid means may be employed to manually propel doors 7. Travel bar support assemblies G support and guide the travel bar F1 where necessary and comprise angle brackets G1, travel bar rollers G2, travel bar covers G3, roller bushings G4 and roller mounting bolts G5. Travel bar F1 is fixedly connected to and is driven by travel bar gear rack F7, shown in FIG. 11. Travel bar movement is controlled by turning control wheel F10, which turns control wheel shaft and sprocket F22, driving chain F13, turning gear unit sprocket F14 and shaft F20, turning gear unit F15, which turns travel bar spur gear F16, driving travel bar rack F7. Idler gear assembly F21 provides a means for adjusting tension on chain F13. Control wheel F10 is provided with a handle F11, slidingly mounted in wheel F10 and alignable with storage opening 10 in face plate 13.

As mentioned previously, travel bar F1 is provided with an index notch F9 for each cell door 7. When an index assembly E for a particular door 7 is activated, index engagement pin E12 will engage the lower edge of travel bar F1 and, as travel bar F1 is moved and index notch F9 passes over index engagement pin E12, it will seat in slot F9 enabling the operator to remotely locate the position of and operate the door 7. The means for transferring motion from engagement pin E12 to cell door 7 will be explained subsequently.

In order to operate cell door 7 in manual mode, it is necessary to disengage all motors K1. This is accomplished during movement of travel bar F1. Motor lift angle F2 is fixedly attached to the top of travel bar F1 and provides a ramp on which motor K1 will pivot upward away from main gear rack L1. Thus, as travel bar F1 begins its travel, motor lift roller K4 rides up motor lift angle F2, disengaging motors K1. Once travel bar F1 has traveled far enough to disengage motors K1, stop bar F17 (see FIGS. 10 and 11) will fall behind the end of travel bar F1, preventing accidental re-engagement of motors K1. Stop bar F17 is maintained in position by stop bar spring F19 and is pivotally mounted to face plate 13 by stop bar handle F18. In order to return to power mode, handle F18 is turned counterclockwise, pivoting stop bar F17 away from travel bar F1, allowing full retraction of travel bar F1.

The motor hold down assembly H provides a means for securing the motor K1 in place when in the power mode of operation. Hold down assembly H comprises a hold down bracket H5 which is bolted or otherwise fixed to travel bar F1 by hold down bolts H3. Bracket H5 contains a hold down spring H2, which urges a hold down pin H1 outward toward motor K1. Cotter pin H6 holds spring H2 in place. When motor K1 is engaged, motor lift roller K4 is held down on the top edge of travel bar F1 by hold down pin H1, preventing motor disengagement due to accident or tampering.

Figure 9:
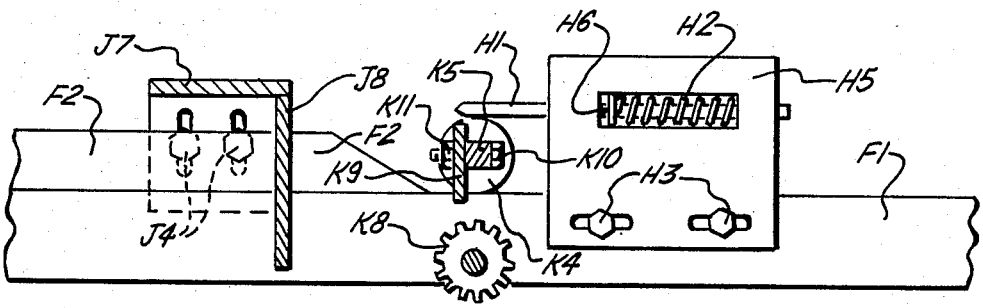
FIG. 9 is a more detailed side view of preferred embodiments of the motor hold down assembly, motor mounting bracket assembly, and motor assembly of this invention taken along line 9—9 of FIG. 8.

The motor mounting bracket assembly J is used to mount each motor K1 to the back of the track box housing A, while also serving as a pivot to engage and disengage the motor K1 to and from the main gear rack L1, as well as to provide a guide/containment feature for the travel bar F1. Motor mounting bracket assembly J and motor assembly K are omitted from FIG. 3 for clarity, but are shown in greater detail in other Figures. Motor mount bracket angle J7 is fixedly attached to the back of track box housing A by bolts J4, as shown in FIG. 9. Bracket plate J8 is fixedly attached to bracket angle J7. Pivoting of motor K1 is accomplished utilizing motor mount pipe J6 which rotatably contains shaft J1. Shaft J1 is connected to motor mount plate J3, which supports motor mount angle J9 which in turn supports motor K1. Additional support for motor K1 when in the engaged position is provided by stop bolt J5, which is adjustably held in position by stop nuts J10.

The motor assembly K provides a power means to propel the door 7 to and from open and closed positions with locking on each end of the door travel. This assembly works in conjunction with electrical circuitry (motor K1 is preferably an electric motor), the motor mounting bracket assembly J, the door carriage main gear rack assembly L and the motor hold down assembly H. Motor K1 drives a gear, preferably a spur gear K8, which engages and drives main gear rack L1. Electrical connections are made via capacitor K3 and wiring harness S. As described above, motor engagement and disengagement is accomplished by motor K1 pivoting on motor mount shaft J1 as motor lift roller K4 climbs motor lift angle F2. Roller K4 is mounted on roller shaft K5 and is held in place by cotter pin K6. Lift bracket K9 connects roller shaft K5 to motor mount angle J9. This connection is adjustable vertically via bolts K10, nuts K11 and lift bracket slots K12.

The door carriage main gear rack assembly L provides a means for transferring motive power to the door 7. While one means for such motion transfer is shown, other means known in the art may be employed. Each cell door is provided with a main gear rack L1. Gear rack L1 is slidingly positioned in main gear rack slides L2, which are fixedly attached to main rack support angles L4. Additional support is provided by means rack retainer bars L6, which are fixedly attached to the lower side of main gear rack L1 via rack retainer spacers L7 and spacer bolts L8. Thus, rack retainer bar L6 slides freely under main rack support angle L4, preventing main gear rack L1 from becoming unseated from main gear rack slides L2. Each rack support angle L4 is attached to the door carriage weldment 01 by main rack bolts L5. The main gear rack L1 is fixedly attached to the lock bar positioner M1 via positioner bolts M3 and spacers M2. The carriage lock regulator assembly N is fixedly attached to the main rack L1 via regulator gear connector bolts N4.

The vertical lock bar positioner assembly M comprises a means to lift (unlock) vertical lock bar 9, allow for door travel, and force vertical lock bar 9 into a locked position. This assembly also includes a means for interaction between the index assembly E and the travel bar assembly F. While there are several means known in the art for actuating lock bar 9, lock bar positioner M1 preferably comprises a flat bar having a central travel slot M8 in which lock bar roller M4 travels during opening and closing movements of the door 7. At either end of central travel slot M8 is an inclined over travel slot M9, for raising or lowering lock bar 9. Overtravel security slots M10 fix lock bar roller M4 in locked position so as to prevent tampering with lock bar 9 when in locked position. Lock bar roller M4 is connected to lock bar 9 via roller shaft M6, which is connected to lock bar head M5, which is in turn connected to lock bar 9. Retainer ring M7 holds roller shaft M6 in position. As stated above, positioner M1 is fixedly connected to main gear rack by spacers M2 and bolts M3. Index engagement pin retainer slot M11 encases index engagement pin E12, and thus provides a means for imparting motion from travel bar F1 (when index engagement pin E12 is in index notch F9) to main gear rack L1 via positioner M1.

The carriage lock regulator assembly N provides a means for translating between door travel and overtravel for the purpose of locking or unlocking at each end of the door travel in either electrical or manual mode. Regulator drive gear rack N1 is fixedly attached to main gear rack by gear connector plate N3, spacers N12 and bolts N4. Regulator gear rack N1 meshes with regulator gear N2. Regulator gear N2 is rotatably connected to door carriage weldment 01 by regulator shaft N5, regulator shaft bushing N6 and regulator snap ring N7. A carriage regulator lock bar N9 is fixedly attached to the back of regulator gear N2. Regulator lock plate N8 maintains a fixed position just below regulator lock bar N9. In the embodiment shown in the Figures, regulator lock plate N8 is fixedly attached to door track Q by spacers N10 and bolts N11. The ends N13 of lock plate N8 are preferably sloped inward as shown in the Figures so as to form an acute interior angle with the upper edge of the lock plate N8. The length of the upper edge of lock plate N8 is equal to the length of the central travel slot M8 of lock bar positioner M1. Thus, as main gear rack L1 is moved by either motor K1 or travel bar F1, the motive force is transferred through regulator gear rack N1 to regulator gear N2. During opening or closing of a door 7, regulator lock bar N9 rides along the upper edge of lock plate N8, preventing regulator gear from turning, causing a further transfer of motive force through regulator shaft N5 to door carriage weldment 01. During locking operations at either end of the door travel, regulator gear N2 is at one end N13 of lock plate N8, and regulator lock bar N9 is no longer prevented from rotating, allowing regulator gear N2 to rotate, providing for the necessary overtravel to accommodate movement of lock bar positioner M1 so as to raise or lower vertical lock bar 9.

The door carriage weldment assembly 0 serves as a means to mount portions of the carriage lock regulator assembly N. The weldment assembly 0 also provides a means for mounting the door carriage wheels 02 and the door hanger R, which supports the cell door 7. Door movement is guided by carriage wheels 02 which are rotatably mounted on door carriage weldment 01 by door carriage wheel studs 06, wheel spacers 05 and wheel stud nuts 03. The door track Q is a flat bar fixedly attached to and extending vertically from the bottom of the track box housing A. The door track Q provides a guide means on which door carriage wheels 02 roll.

A limit switch and door limit bracket assembly P is provided at either end of the door travel, and includes a limit switch P2 which controls motor operation as well as indicator lights P5 at the control cabinet 8. This assembly also limits the extent of overtravel of the lock bar positioner M1 by means of positioner stop P3. An angle bracket P1 is fixedly positioned in track box housing A at either end of the extent of travel of main gear rack L1. A limit switch P2 is mounted on each bracket P1 and is connected to wiring harness S so as to deactivate motor K1 and activate the appropriate indicator light P5 when contacted by limit switch activator arm P6, attached to either end of main gear rack L1.

Door hanger R1 connects the door carriage weldment 01 to the door 7 by bolts R2. This allows travel of door 7 without interfering with the mechanism inside of the track box housing A or the fixed grating 5. Door hanger R1 passes through a slot A2 in the bottom of track box housing A. Slot cover channel U is provided to prohibit contraband from being placed in the track box housing through slot A2. Slot cover channel U is provided with its own slot U1 which is long enough to accommodate the door hanger R1. Thus, slot cover channel U will ride back and forth with door hanger R1, covering track box slot A2.

Electrical connections are maintained via motor wiring harness assembly S at each door 7 and cable harness T which connects the various wiring harness assemblies S to the control cabinet 8. Remote operation of the system is accomplished at control cabinet 8, requiring no entry into the cell block 1 for either electrical or mechanical operation.

POWER OPERATION

In a typical scenario of normal operation, an officer in control area 4 unlocks control cabinet 8 and determines which door 7 he would like to operate. All of the doors 7 are shown in the locked closed position in FIG. 1. By manipulating a three position switch 12 the officer can electrically operate any door 7 individually. All of the doors 7 may be operated electrically by the same action of the three position switch 12 for each door 7. The officer may also operate all doors in a cell block 1 in group or gang fashion by turning the group switch 14.

In order to examine operation, assume that a door 7 is in the locked closed position. Switch 12 is turned to the "open" position, energizing the capacitor K3 which starts motor K1 above door (7) turing motor spur gear K8. Spur gear K8 is in contact with main gear rack L1 (travel bar F1 is fully retracted). Thus, rotation of spur gear K8 causes main gear rack L1 to move horizontally toward the open position. This action starts the unlock phase of door movement.

As the main gear rack L1 is moved, it moves the lock bar positioner M1 and the carriage lock regulator assembly N simultaneously. The carriage lock regulator assembly N will not move door 7 until the lock bar positioner M1 has traveled sufficiently to unlock the door. This is accomplished by the horizontal motion of the positioner M1 causing the vertical lock bar roller M4 to ride up the inclined overtravel slot M9 of the positioner M1.

As the main gear rack L1 and positioner M1 move, the closed side limit switch P2 is left open thereby activating an indicator light P5 in the control cabinet 8, advising the officer that the door 7 is in the travel mode. When the main gear rack L1 starts the horizontal motion toward the open position, allowing the positioner M1 to lift the vertical lock bar head M5, the carriage lock regulator gear N2 is rotating in the carriage weldment 01. When the rotation is sufficient for the regulator lock bar N9 to be horizontal, it is allowed to contact the regulator lock plate N8, after rotating around the end N13 of lock plate N8. When rotation is complete and the upper edge of lock plate N8 prevents further rotation of regulator gear N2, by means of regulator lock bar N9 bearing against the top edge of regulator lock plate N8. The door 7 is now completely unlocked and is allowed to travel toward the open position. When door travel is complete, the door 7 reaches a fully open position and the lock cycle begins in order to lock the door 7 in the open position. Indications that the door travel is complete are: (a) the door has visibly completed its travel; (b) the carriage regulator lock bar N9 has reached the opposite end N13 of lock plate N8; and (c) the vertical lock bar roller M4 is at the beginning of the opposite inclined overtravel slot M9 from where it started, ready to start downward overtravel.

The lock cycle begins with the door 7 stopping its travel against a door jamb (not shown). The motor spur gear K8 continues to drive the main gear rack L1. The main gear rack L1 moves the regulator gear rack N1, causing the regulator gear N2 to rotate in the door carriage weldment 01. The carriage regulator lock bar N9 will rotate around and capture the end N13 of lock plate N8. The position of regulator lock bar N9 against the inclined end N13 of lock plate N8 provides a carriage lock which locks the door 7 in open (or closed) position. As this is happening, the positioner M1 causes the lock bar roller M4 to be forced down inclined overtravel slot M9, causing vertical downward movement of the lock bar head M5, thus locking the door 7. The door 7 is now locked via the vertical lock bar 9 and the interaction of regulator lock bar N9 with lock plate N8.

MANUAL OPERATION

Operation of the system in the manual mode is virtually the same as in the electrical mode, at least as far as the movement of the main gear rack L1 is concerned. Manual operation simply involves a means, other than motor K1, providing motive power to the main gear rack L1. Since no modifications are required to the door carriage main gear rack assembly L, the vertical lock bar positioner assembly M, the carriage lock regulator assembly N, the door carriage weldment 0, the door track Q or the door hanger R, the versatility of individual power operation of doors 7 is preserved. Index assembly E provides a simplified and reliable means for operating the above assemblies, as in power mode, from the control area 4.

Figure 11:
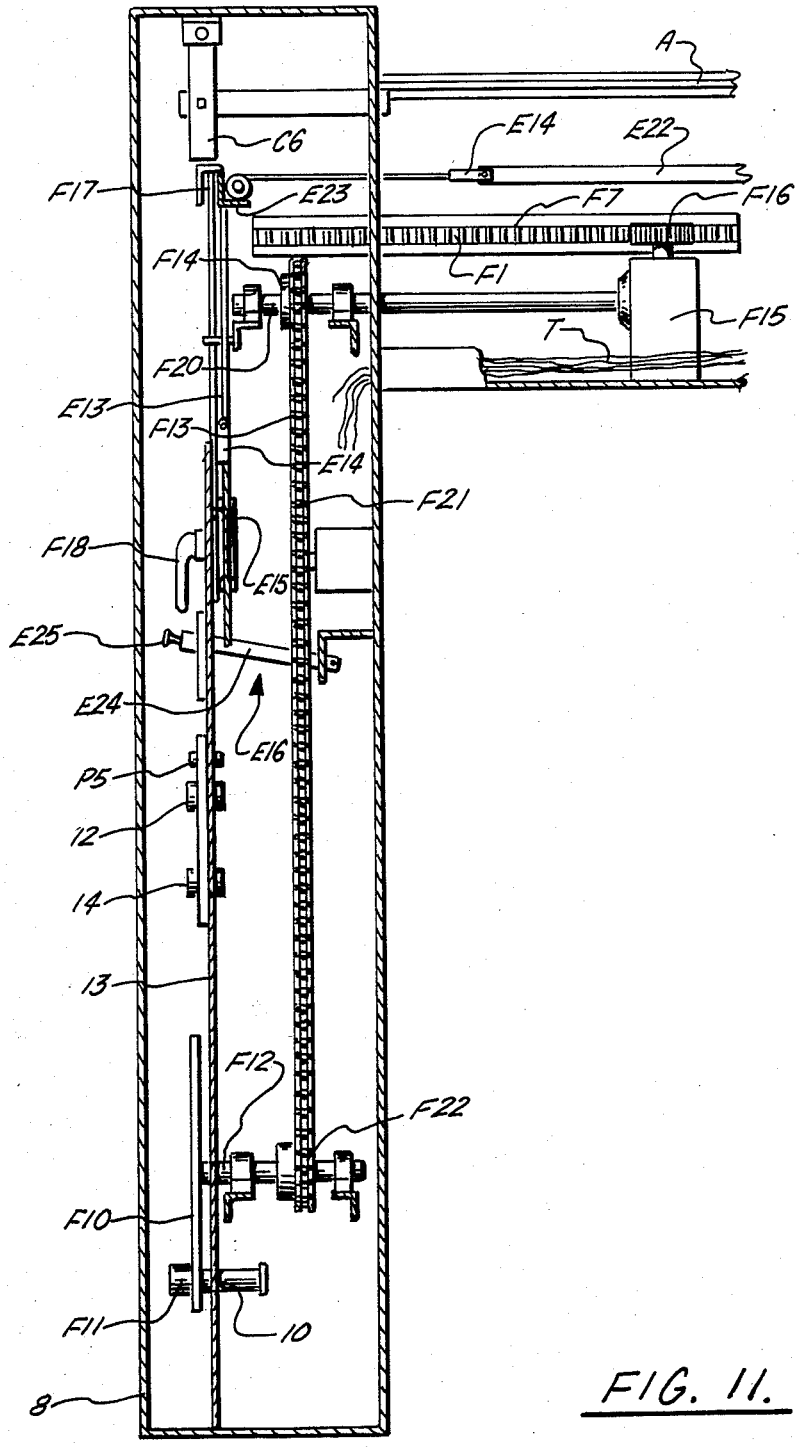
FIG. 11 is a sectional view of a preferred embodiment of the control cabinet of this invention, taken along line 11—11 of FIG. 10.
Figure 12:
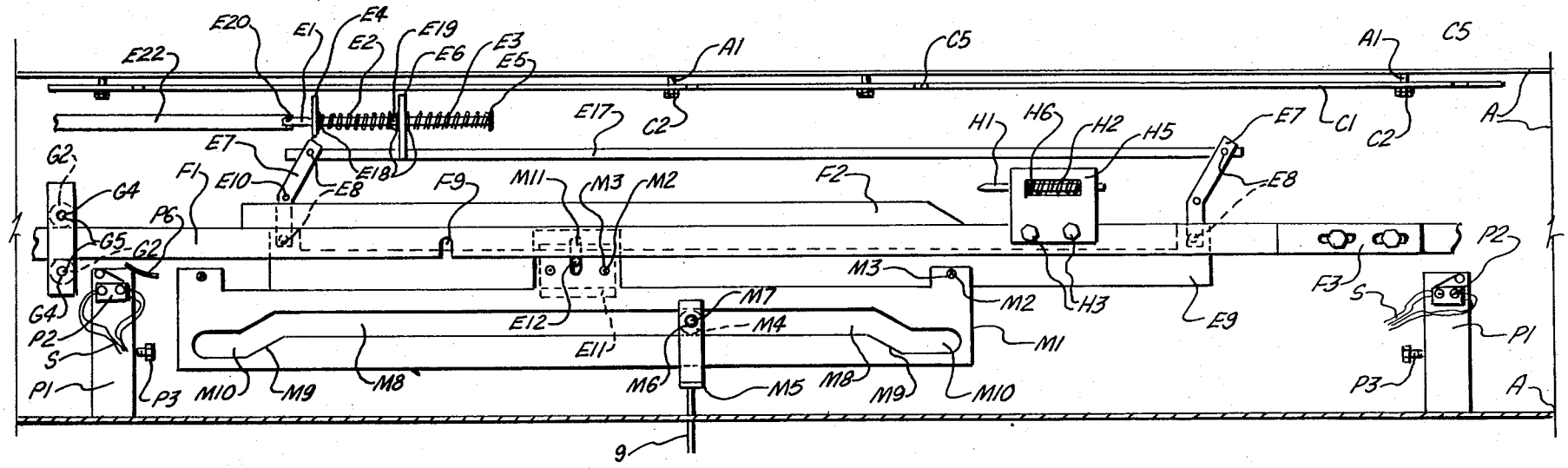
FIG. 12 is a sectional view of a preferred embodiment of the invention, taken along line 12—12 of FIG. 3.

When manual operation is desired an officer, without entering the inmate corridor 3, opens the control cabinet 8 and determines which door(s) 7 he would like to operate. Index selector pins E16 are numbered, one for each cell door 7. As shown in FIG. 11, the index selector pins E16 are normally in the "indexed up" or "indexed off" position. As explained previously, index pins E16 are biased in this position by the force exerted by first index spring E2. Selection is accomplished by selecting a numbered index selector pin E16 and pulling it downward and pushing the head E25 into selector hole E27 thus holding selector pin E16 in a detent position. Selector hole E27 holds the detent position until such time as selector pin E16 is pulled out and released to the "indexed up" position.

To operate door 7 the officer then grasps the control wheel handle F11 and pulls it from its storage opening 10 in face plate 13. The officer then turns control wheel F10, causing travel bar F1 to move in track box housing A. As the end of travel bar F1 moves away from control cabinet 8, stop bar F17 is pulled by stop bar spring F19 into a "closed" or "stop" position, blocking the complete return of travel bar F1 until the officer turns stop bar handle F18, allowing complete retraction of travel bar F1 and return to power mode. Of course, stop bar F16 could be manually placed in stop position if spring F19 were not provided. In order to manually run the door(s) 7 through complete travel to open (or closed) position, the control wheel F10 is turned until it stops, indicating that the travel bar F1 and door(s) 7 have reached the end of their travel and the door(s) 7 is(are) completely opened (or closed) and locked.

When the officer selects a door 7 by pulling down on the index selector pin E16, pin E16 pulls index cable E13, which pulls index connector E22, which in turn pulls index rod E1, compressing springs E2,E3 and moving index rocker connecting bar E17. This movement causes index rockers E7 to rotate and lift the index engagement pin E12. Since index engagement pin E12 is not likely aligned with index notch F9, index engagement pin E12 has traveled only a portion of its total vertical travel. Thus, the index engagement pin E12 is now bearing on the underside of travel bar F1 under pressure caused by the stored energy in index spring E3.

Rotation of control wheel F10, through the mechanism previously described, causes travel bar spur gear F16 to mesh with and drive travel bar rack F7, which horizontally moves travel bar F1. The direction of travel bar F7 movement is dependent upon the direction of rotation of control wheel F10. Preferably, clockwise rotation of control wheel F10 causes travel bar F1 (and door(s) 7) to move toward open position and counterclockwise rotation causes movement toward closed position. As travel bar F1 begins movement from a fully retracted position, the motor lift angle F2 on travel bar F1 lifts motor K1 from engagement with main gear rack L1 by the action of motor lift roller K4 riding up lift angle F2. The initial travel of travel bar F1 which is required to disengage motor K1 is preferably coincidental with the initial travel required before stop bar F17 moves to stop position, preventing re-engagement of motor K1 unless desired by the officer.

When travel bar F1 has traveled sufficiently for the index notch F9 to align with index engagement pin E12, the stored energy in the index springs E3 causes the index engagement pin E12 to snap up into position in notch F9. When index engagement pin E12 is seated in notch F9, the main gear rack L1 is then connected so as to move with the travel bar F1. Thus, when the officer rotates the control wheel F10 further in the appropriate direction, the door carriage weldment assembly 0 moves accordingly. It should be noted that the index engagement pin E12 can be released at any time (by placing the index selector pin E16 in the indexed up position) and can be retrieved at any time during manual operation (by again placing index selector pin E16 in the detent position). When released during door travel movements, the door 7 is released to inmate control ("free wheeling operation"). To reacquire control of a door 7, the officer need only place selector pin E16 in the detent position and rotate control wheel F10 until index engagement pin E12 snaps back into position. Thus, the index assembly E allows an officer to manually search for, and retrieve, control of a particular door 7.

In order to return to power operation, the officer first removes any index selector pins E16 from their detent positions, releasing index engagement pins E12 from notches F9. Index springs E2,E3 cause both the release of engagement pin E12 and the return of selector pin E16 to the index up position. The officer then rotates the control wheel F10 so as to retract travel bar F1 toward the control cabinet 8. Stop bar F17 will limit this movement, and must be rotated away from travel bar F1 to allow return to power mode. When the travel bar F1 has moved to the appropriate position, the motor lift roller K4 rolls down the motor lift angle F2. When the motor lift roller K4 is in contact with the top of the travel bar F1, the motor hold down pin H1 travels over the motor lift roller K4, thus holding it down in position. As this action is taking place, the motor spur gear K8 is traveling in an arc, pivoting at the motor mount shaft J1, downward to mesh with the main gear rack L1. If the gears are not properly aligned, the motor hold down pin H1 is spring loaded and will accommodate the gears until the motor K1 is energized, causing the motor spur gear K8 to fall into main gear rack L1.

Therefore, it can be seen that a jail door operating and locking mechanism is provided which allows selective electrical or annual operation and locking of cell doors from a remote location. An improved and simplified overtravel device and indexing mechanism are also provided. Although specific embodiments of the invention are described in detail herein, other embodiments will occur to those skilled in the art, and are intended to be included within the scope and spirit of the following claims.

I claim:

1. A jail door operating and locking mechanism, comprising:

a. at least one fixed frame across the front of a plurality of aligned jail cells and having a plurality of passageways therethrough;

b. a plurality of sliding cell doors, each said door slidingly movable across one said passageway;

c. a plurality of door carriage weldment means, each fixedly connected to each said cell door, for imparting sliding movement to said cell doors between open and closed positions;

d. a plurality of vertical lock bars, slidingly positioned in said frame such that at least one said lock bar is provided for each said door, each said lock bar having a locked position whereby said cell door is locked with relation to said frame, and an unlocked position, whereby said cell door is free to travel between said open and closed positions;

e. a plurality of means, each positioned over each said cell door, for transferring motive power to each said door carriage weldment means;

f. a plurality of lock bar positioner means, each fixedly attached to said means for transferring motive power and operatively connected to at least one said vertical lock bar, for moving said lock bar between said locked and unlocked positions;

g. a plurality of power means, for propelling said means for transferring motive power, each said power means operatively engageable with one said means for transferring motive power and operable from a remote location;

h. a continuous bar means, slidingly positioned above said doors, for manually operating said lock bar positioner means and said means for transferring motive power; and i. a plurality of means for activating manual door operation, each operable from a remote location and selectively and linkingly engageable with said continuous bar means and one said means for transferring motive power such that movement of said continuous bar means will operate a desired number of said means for transferring motive power.

2. A jail door operating and locking mechanism according to claim 1, wherein each said means for activating manual door operation comprises:

i. a fixed stop, fixedly attached to a fixed surface above said door;

ii. a rod, having first and second ends and slidingly attached between said ends to said fixed stop and having said first end attached to an index connector;

iii. a first spring means, connected to said rod, for maintaining tension on said index connector;

iv. a fixed movable stop, slidingly positioned on said rod between said first spring and said second end of said rod;

v. a second spring, compressibly mounted on said rod between said fixed movable stop and said second end of said rod;

vi. an end stop, mounted on said second end of said rod so as to retain said second spring; and vii. a means, fixedly connected to said fixed movable stop, for linking said means for transferring motive power to said continuous bar means.

3. A jail door operating and locking mechanism according to claim 2, wherein said means for linking said means for transferring motive power to said continuous bar means comprises:

i. a connector bar, fixedly attached to said fixed movable stop;

ii. a plurality of rockers, having first and second ends, said first end of each said rocker being pivotally connected to said connector bar, each said rocker being further pivotally attached at a point between said first and second ends to a fixed surface;

iii. an index slide bar, pivotally attached to said second ends of said rockers;

iv. an index engagement pin, attached to said index slide bar so as to permit horizontal movement relative to said index slide bar, but so as to move vertically coincidental with said index slide bar;

and wherein said continuous bar means is provided with an index notch.

4. A jail door operating and locking mechanism according to claim 1, further comprising a carriage lock regulator assembly, which in turn comprises:

i. a regulator gear rack, fixedly attached to said means for transferring motive power;

ii. a regulator gear, meshingly attached to said regulator gear rack and rotatably attached to said door carriage weldment means;

iii. a regulator lock bar fixedly attached to said regulator gear; and iv. a regulator lock plate, fixedly attached to a fixed surface below said regulator gear and having an upper edge and ends, said regulator lock plate being positioned such that, during door travel, said upper edge of said lock plate is positioned just under or just abutting said regulator lock bar, said regulator lock plate being positioned substantially horizontally during door travel, and wherein said regulator lock plate is of such a length that, when said door reaches said open or closed positions, said regulator lock bar will rotate around one said end of said lock plate allowing rotation of said regulator gear.

5. A jail door operating and locking mechanism according to claim 4, wherein said ends of said regulator lock plate are sloped inward so as to form an acute interior angle with said upper edge of said lock plate.

6. A jail door operating and locking mechanism, comprising:

a. a fixed frame across the front of a jail cell and having a passageway therethrough;

b. a cell door, slidingly movable across said passageway;

c. a door carriage weldment means, fixedly connected to said cell door, for imparting sliding movement to said cell door between open and closed positions;

d. a lock bar, slidingly positioned in said frame such that said lock bar has a locked position whereby said cell door is locked with relation to said frame, and an unlocked position, whereby said cell door is free to travel between said open and closed positions;

e. a means, positioned over each said cell door, for transferring motive power to said door carriage weldment means;

f. a lock bar positioner means, fixedly attached to said means for transferring motive power and operatively connected to said lock bar, for moving said lock bar between said locked and unlocked positions;

g. a carriage lock regulator assembly, comprising:

i. a regulator gear rack, fixedly attached to said means for transferring motive power;

ii. a regulator gear, meshingly attached to said regulator gear rack and rotatably attached to said door carriage weldment means;

iii. a regulator lock bar fixedly attached to said regulator gear; and iv. a regulator lock plate, fixedly attached to a fixed surface below said regulator gear and having an upper edge and ends, said regulator lock plate being positioned such that, during door travel, said upper edge of said lock plate is positioned just under or just abutting said regulator lock bar, said regulator lock plate being positioned substantially horizontally during door travel, and wherein said regulator lock plate is of such a length that, when said door reaches said open or closed positions, said regulator lock bar will rotate around one said end of said lock plate allowing rotation of said regulator gear.

7. A jail door operating and locking mechanism according to claim 6, wherein said ends of said regulator lock plate are sloped inward so as to form an acute interior angle with said upper edge of said lock plate.

8. A jail door operating and locking mechanism, comprising:

a. at least one fixed frame across the front of a plurality of aligned jail cells and having a plurality of passageways therethrough;

b. a plurality of sliding cell doors, each said door sligingly moveable across one said passageway;

a plurality of door carriage weldment means, each fixedly connected to each said cell door, for imparting sliding movement to said cell doors between open and closed positions;

d. a plurality of vertical lock bars, slidingly positioned in said frame such that at least one said lock bar is provided for each said door, each said lock bar having a locked position whereby said cell door is locked with relation to said frame, and an unlocked position, whereby said cell door is free to travel between said open and closed positions;

e. a plurality of means, each positioned over each said cell door, for transferring motive power to each said door carriage weldment means;

f. a plurality of lock bar positioner means, each fixedly attached to said means for transferring motive power and slidingly connected to at least one said vertical lock bar, for moving said lock bar between said locked and unlocked positions;

g. a continuous bar means, slidingly positioned above said doors, for manually operating said lock bar positioner means and said means for transferring motive power; and h. a plurality of index assemblies, each operable from a remote location and selectively and linkingly engageable with said continuous bar means and one said means for transferring motive power such that movement of said continuous bar means will operate a desired number of said means for transferring motive power, each said index assembly further comprising:

i. a fixed stop, fixedly attached to a fixed surface above said door;

ii. a rod, having first and second ends and slidingly attached between said ends to said fixed stop and having said first end attached to an index connector;

iii. a first spring means, connected to said rod, for maintaining tension on said index connector;

iv. a fixed movable stop, slidingly positioned on said rod between said first spring and said second end of said rod;

v. a second spring, compressibly mounted on said rod between said fixed movable stop and said second end of said rod;

vi. an end stop, mounted on said second end of said rod so as to retain said second spring on said rod; and vii. a means, fixedly connected to said fixed movable stop, for linking said means for transferring motive power to said continuous bar means.

9. A jail door operating and locking mechanism according to claim 8, further comprising:

g. a carriage lock regulator assembly, comprising:

i. a regulator gear rack, fixedly attached to said means for transferring motive power;

ii. a regulator gear, meshingly attached to said regulator gear rack and rotatably attached to said door carriage weldment means;

iii. a regulator lock bar fixedly attached to said regulator gear; and iv. a regulator lock plate, fixedly attached to a fixed surface below said regulator gear and having an upper edge and ends, said regulator lock plate being positioned such that, during door travel, said upper edge of said lock plate is positioned just under or just abutting said regulator lock bar, said regulator lock plate being positioned substantially horizontally during door travel, and wherein said regulator lock plate is of such a length that, when said door reaches said open or closed positions, said regulator lock bar will rotate around one said end of said lock plate allowing rotation of said regulator gear.

10. A jail door operating and locking mechanism according to claim 9, wherein said ends of said regulator lock plate are sloped inward so as to form an acute interior angle with said upper edge of said lock plate.

11. A jail door operating and locking mechanism, comprising:

a. at least one fixed frame across the front of a plurality of aligned jail cells and having a plurality of passageways therethrough;

b. a plurality of sliding cell doors, each said door slidingly movable across one said passageway;

c. a plurality of door carriage weldment means, fixedly connected to each said cell door, for imparting sliding movement to said cell doors between open and closed positions;

d. a plurality of vertical lock bars, slidingly positioned in said frame such that at least one said lock bar is provided for each said door, each said lock bar having a locked position whereby said cell door is locked with relation to said frame, and an unlocked position, whereby said cell door is free to travel between said open and closed positions;

e. a plurality of means, each positioned over each said cell door, for transferring motive power to each said door carriage weldment means;

f. a plurality of lock bar positioner means, each fixedly attached to said means for transferring motive power and slidingly connected to at least one said vertical lock bar, for moving said lock bar between said locked and unlocked positions;

g. a plurality of power means, for propelling said means for transferring motive power, each said power means operatively engageable with one said means for transferring motive power and operable from a remote location;

h. a continuous bar means, slidingly positioned above said doors, for manually operating said lock bar positioner means and said means for transferring motive power and for disengaging said power means prior to manual operation and re-engaging said power means following manual operation; and i. a stop bar assembly, attached to a fixed surface and movable to a position so as to prevent re-engagement of said power means while said continuous bar means is manually operating said cell doors.

12. A jail door operating and locking mechanism according to claim 11 wherein said stop bar assembly comprises a stop bar, rotatably attached to a fixed surface near one end of said continuous bar means and movable to a position so as to block return movement of said continuous bar means once said one end passes said stop bar.

13. A carriage lock regulator assembly for a jail door operating and locking mechanism, comprising:

i. a regulator gear rack, fixedly attached to a means for transferring motive power;

ii. a regulator gear, meshingly attached to said regulator gear rack and rotatably attached to a door carriage weldment means;

iii. a regulator lock bar fixedly attached to said regulator gear; and iv. a regulator lock plate, fixedly attached to a fixed surface below said regulator gear and having an upper edge and ends, said regulator lock plate being positioned such that, during door travel, said upper edge of said lock plate is positioned just under or just abutting said regulator lock bar, said regulator lock plate being positioned substantially horizontally during door travel, and wherein said regulator lock plate is of such a length that, when said door reaches open or closed positions, said regulator lock bar will rotate around one said end of said lock plate.

14. A carriage lock regulator assembly for a jail door operating and locking mechanism according to claim 13, wherein said ends of said regulator lock plate are sloped inward so as to form an acute interior angle with said upper edge of said lock plate.

15. An index assembly for a jail door operating and locking mechanism, comprising:

i. a fixed stop, fixedly attached to a fixed surface above a sliding cell door;

ii. a rod, having first and second ends and slidingly attached between said ends to said fixed stop and having said first end attached to an index connector;

iii. a first spring means, connected to said rod, for maintaining tension on said index connector;

iv. a fixed movable stop, slidingly positioned on said rod between said first spring and said second end of said rod;

v. a second spring, compressibly mounted on said rod between said fixed movable stop and said second end of said rod;

vi. an end stop, mounted on said second end of said rod so as to retain said second spring; and vii. a means, fixedly connected to said fixed movable stop, for linking a means for transferring motive power to a continuous bar means.

16. An index assembly for a jail door operating and locking mechanism according to claim 15, wherein said means for linking said means for transferring motive power to said continuous bar means comprises:

i. a connector bar, fixedly attached to said fixed movable stop;

ii. a plurality of rockers, having first and second ends, said first end of each said rocker being pivotally connected to said connector bar, each said rocker being further pivotally attached at a point between said first and second ends to a fixed surface;

iii. an index slide bar, pivotally attached to said second ends of said rockers;

iv. an index engagement pin, attached to said index slide bar so as to permit horizontal movement relative to said index slide bar, but so as to move vertically coincidental with said index slide bar;

said index assembly further comprising a continuous bar means, slidingly positioned above said sliding cell door, for manually operating said cell door, said continuous bar means being positioned vertically adjacent to said index engagement pin and having an index notch.

* * * * *